US005745982A

United States Patent [19]

Klinedinst

[11] Patent Number: 5,745,982

[45] Date of Patent: May 5, 1998

[54] LIFTING DEVICE FOR A CRIMPED WIRE ASSEMBLY

[75] Inventor: Steven Zane Klinedinst, York, Pa.

[73] Assignee: The Whitaker Corporation, Wilmington, Del.

[21] Appl. No.: 754,709

[22] Filed: Nov. 22, 1996

[51] Int. Cl.[6] ..... H01R 43/048

[52] U.S. Cl. ..... 29/753; 29/759; 29/760; 29/863; 72/712

[58] Field of Search ..... 29/753, 759, 760, 29/863; 72/409.06, 409.14, 712

[56] References Cited

U.S. PATENT DOCUMENTS

| | | | |
|---|---|---|---|
| 3,550,239 | 12/1970 | Rider | 29/753 X |
| 3,875,662 | 4/1975 | Folk | 29/863 |
| 4,031,613 | 6/1977 | Brown et al. | 29/863 |
| 4,040,180 | 8/1977 | Brown | 29/753 |
| 4,043,032 | 8/1977 | Spangler | 29/863 |
| 4,398,337 | 8/1983 | Yamaguti et al. | 29/753 X |
| 4,979,291 | 12/1990 | Phillips et al. | 29/753 X |

FOREIGN PATENT DOCUMENTS

| | | | |
|---|---|---|---|
| 1298076 | 5/1962 | France | 29/753 |
| 6140121 | 5/1994 | Japan | 29/763 |

*Primary Examiner*—Peter Vo

[57] ABSTRACT

An apparatus (40) is disclosed for crimping a terminal (12) onto a wire (10) thereby forming a crimped wire assembly (32). The apparatus includes an upper die form tool (78) and a mating lower deep crimping nest (74) for performing the crimping operation. A terminal feed unit (86) is provided for feeding a strip (24) of terminals along a feed path (180) and positioning each terminal, in turn, in crimping position between the mating tooling. A lifting arm (134) is provided for separating the crimped wire assembly (32) from the deep crimping nest (74). The arm is pivotally attached to the apparatus and includes a first end having a camming surface (160, 162) arranged to engage the crimped wire assembly, and upon pivoting of the arm, the camming surface cams the crimped wire assembly (32) out of the deep crimping nest (74) in a direction (178) substantially perpendicular to the feed path (180) and then moves the wire assembly (32) in a direction along the feed path.

10 Claims, 8 Drawing Sheets

LIFTING DEVICE FOR A CRIMPED WIRE ASSEMBLY

The present invention relates to apparatus for crimping terminals onto conductors and more particularly to such apparatus having a lifting device for removing the crimped assembly from the crimping die.

BACKGROUND OF THE INVENTION

Applicator machines for the attachment of electrical terminals to very large conductors usually include a press having a movable ram that is arranged to undergo reciprocating motion toward and away from a bolster plate. Crimping tooling is provided consisting of a fixed anvil that is attached to the bolster plate and a mating upper die that is attached to and carried by the ram. The terminals, arranged on a plastic carrier strip, are drawn from a reel by a feed mechanism and positioned, one at a time, in alignment with the anvil and upper die. A stripped end of a wire is manually inserted into the barrel of the terminal and the press actuated to crimp the terminal onto the wire. Such a machine is disclosed in U.S. Pat. No. 4,031,613 which issued Jun. 28, 1977 to Brown et al., and U.S. Pat. No. 4,040,180 which issued Aug. 9, 1977 to Brown. In both of these patents, the machine includes a pivotal lifting device that serves two purposes. The first purpose being to guide the stranded wire end during operator insertion of the wire end into the barrel of the terminal prior to crimping, and the second to separate the crimped wire assembly from the anvil as the strip of terminals is advanced to position the next terminal in alignment with the anvil. Since many types of terminals are now being supplied with generous chamfers on the outfacing edge of the barrel opening which serve to guide the wire end as it is being inserted into the opening, the guiding function of the lifting member, in these cases, is less important. On the other hand, the deep forming cavity of the anvil tends to trap the crimped barrel, making it difficult to manually remove the crimped wire assembly before the next terminal is advanced into position. To address this problem the pivoting lifting member includes a nest that closely receives the wire adjacent the terminal barrel and is arranged to lift the crimped wire assembly upwardly out of the cavity of the anvil and then in the direction of feed. But, in order to release the wire assembly the nest is usually split so that it can be opened to allow the wire assembly to be removed and the lifting member returned to receive the next wire. This, of course adds to the complexity of the mechanism and tends to make it more cumbersome and slow in operation.

What is needed is a pivoting lifting member that is a single rigid structure that, by pivotal motion of the lifting member about a single pivot axis, the crimped wire assembly can be first moved upwardly and out of the deep forming cavity of the anvil, then moved laterally in the direction of feed, and manually removed from the carrier strip.

SUMMARY OF THE INVENTION

An apparatus is disclosed for crimping a terminal onto the stripped end of a large diameter wire thereby forming a crimped wire assembly. The apparatus includes a first tooling unit and a second tooling unit movable toward and matable with the first tooling unit in a work station for effecting the crimping. A terminal feed unit is provided for feeding a strip of terminals from an upstream side of the work station along a feed path through the work station toward a downstream side thereof. A lifting device is provided for separating the crimped wire assembly from the first tooling unit The lifting device includes an arm pivotally attached to the first tooling unit. The arm has a first end arranged so that when the arm is pivoted in a first direction the first end moves from a first position adjacent the work station to a second position on the downstream side of the work station. The first end has a camming surface arranged to engage the crimped wire assembly, and upon pivoting of the arm in the first direction, the camming surface cams the crimped wire assembly out of the first tooling in a direction substantially perpendicular to the feed path and then moves it along the feed path in a direction toward the downstream side of the work station.

DESCRIPTION OF THE PREFERRED EMBODIMENT

Figure 1:
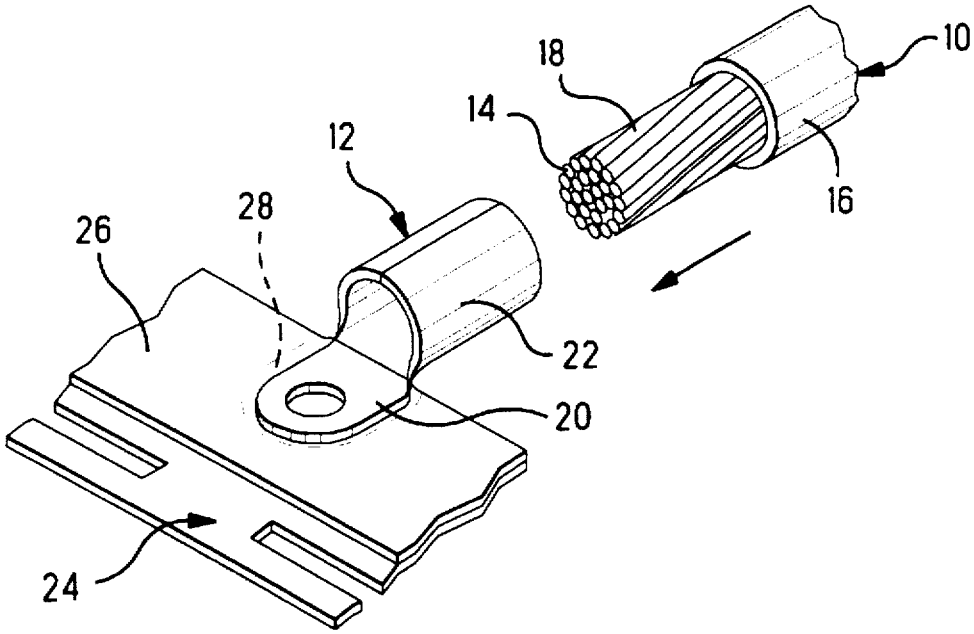
FIG. 1 is an isometric view of a wire having a stripped end and a terminal to be crimped thereto.
Figure 2:
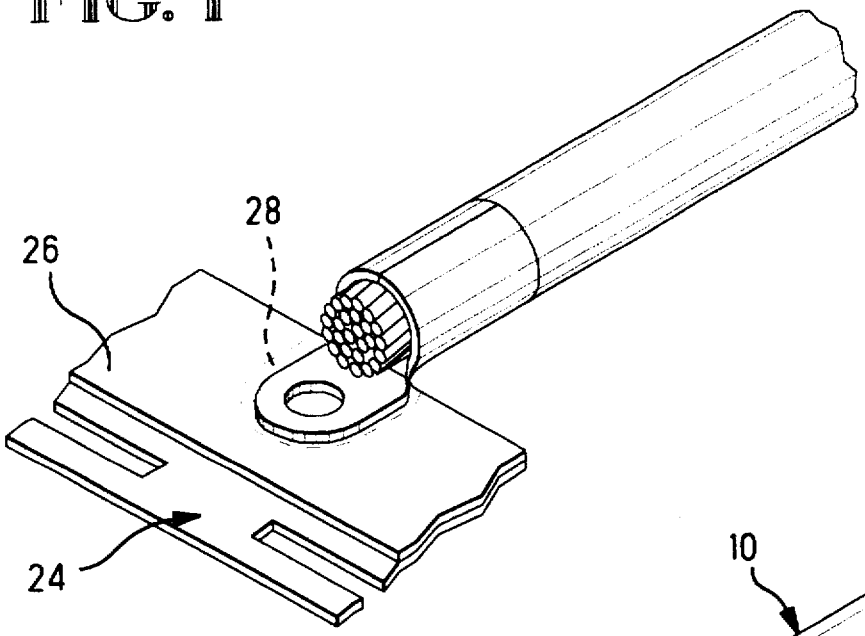
FIG. 2 is a view similar to that of FIG. 1 showing the wire end inserted into the barrel of the terminal.
Figure 3:
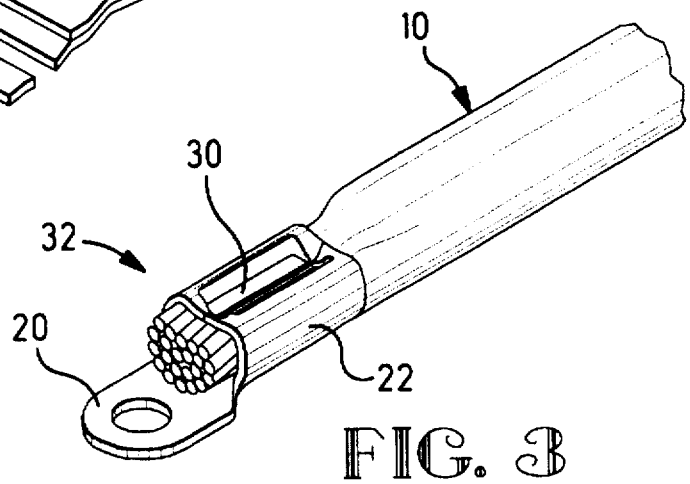
FIG. 3 is a view similar to that of FIG. 1 showing the barrel of the terminal crimped to the wire end.

There is shown in FIGS. 1, 2, and 3 a wire 10 and terminal 12 of the type to be crimped by the machine of the present invention that will be described below. The wire 10 includes a multi-stranded conductor 14 and an outer insulating jacket 16, a portion of which is stripped away to form a stripped end 18. The wire 10 in the present example is of relatively large gage, generally having a conductor diameter larger than about 0.250 inch. The terminal 12 to be crimped onto the end 18 includes a terminal portion 20 and a barrel 22 having a hole for loosely receiving the end 18. The terminal 12 is carried by a carrier strip 24 having a thin plastic layer 26 attached thereto that sandwiches the terminal portion of each terminal 12 therebetween. The layer 26 is thermal-tacked to the carrier strip 24 to form pockets 28 which hold the terminals in place. As will be explained, when the terminal 12 is in position with respect to the crimping tooling, the wire end 18 is manually inserted into the barrel 22, as shown in FIG. 2, and then crimped as shown at 30 in FIG. 3 to produce a crimped wire assembly 32. The required force imposed by the crimping tooling to produce a high quality crimp is about 9000 pounds. A terminal applicator machine 40 for making the crimped wire assembly 32 will now be describe with reference to FIGS. 4 through 9.

The machine 40, as shown in FIGS. 4, 5, 6, and 7, includes a commercially available press 42 having a ram 44. A die shoe set 46 is positioned within the press and comprises a lower bolster plate 48 having two vertically disposed guide posts 50 extending therefrom and an upper plate 52 in sliding engagement with the guide posts arranged to move vertically toward and away from the bolster plate. The press ram 44 is coupled to and carries the upper plate 52 in the usual manner. Terminal applicator tooling 60 includes a frame 62 attached to the bolster plate 48 by means of screws 64, and an upper tooling unit 66 attached to the upper plate 52 by means of screws 68. A lower tooling unit 70 is held in the frame 62 and includes a crimping anvil 72 having a relatively deep crimping nest 74. The upper tooling unit 66 includes a crimping bar 76 having a die form 78 that cooperates with the nest 74 in forming the crimp 30 in a work station 82. The crimping bar 76 is arranged to undergo limited vertical movement, as viewed in FIG. 4, and is urged downwardly by a spring 80. As will be described in detail below, when the ram 44 has moved the upper plate 52 downwardly to its intermediate position, shown in FIG. 4, the die form 78 lightly engages the barrel 22 of the terminal 12 that is in the nest, thereby holding the terminal steady while the wire end 18 is manually inserted into the barrel.

Figure 4:
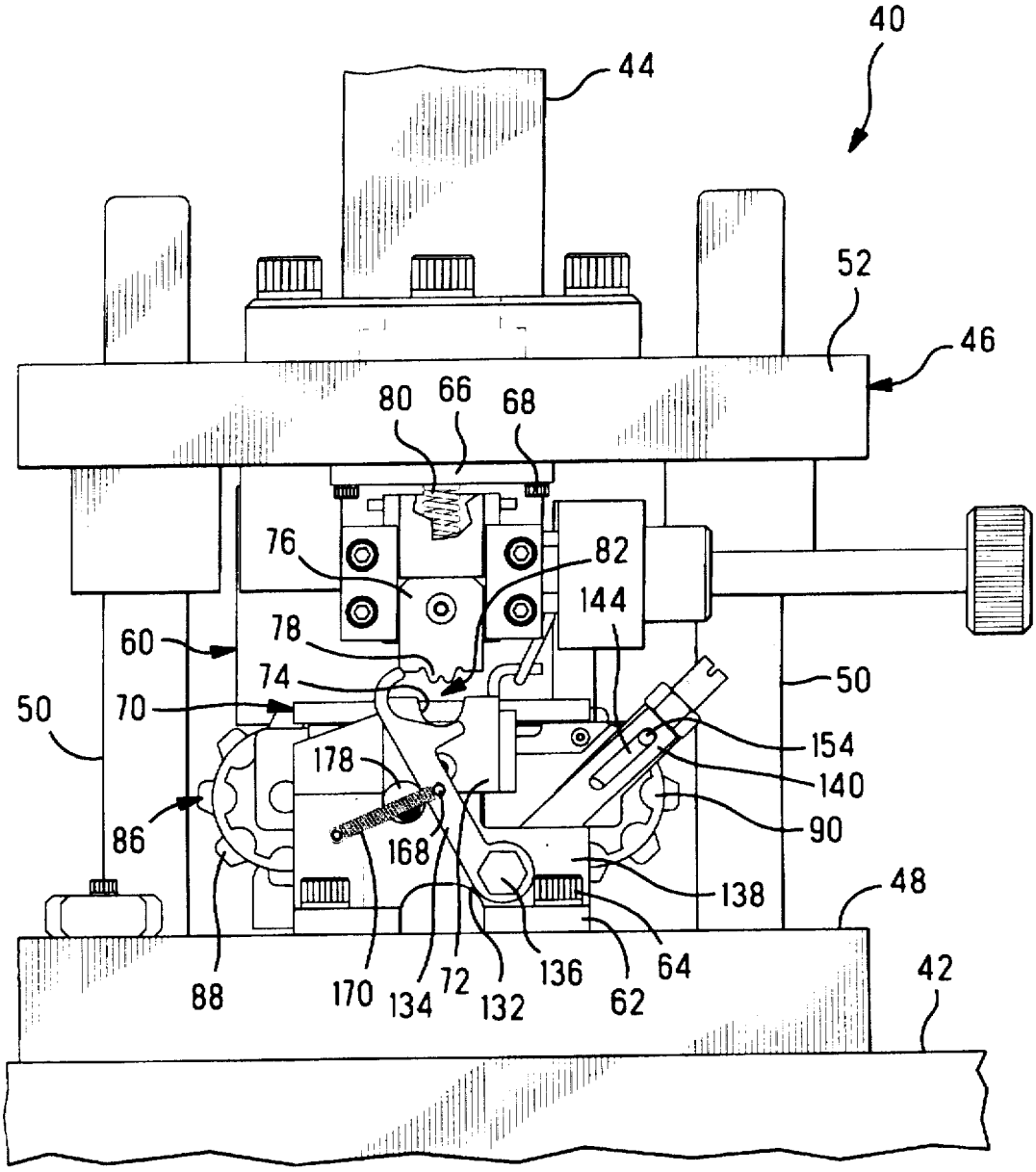
FIG. 4 is a front view of a terminal applicator machine incorporating the teachings of the present invention.
Figure 6:
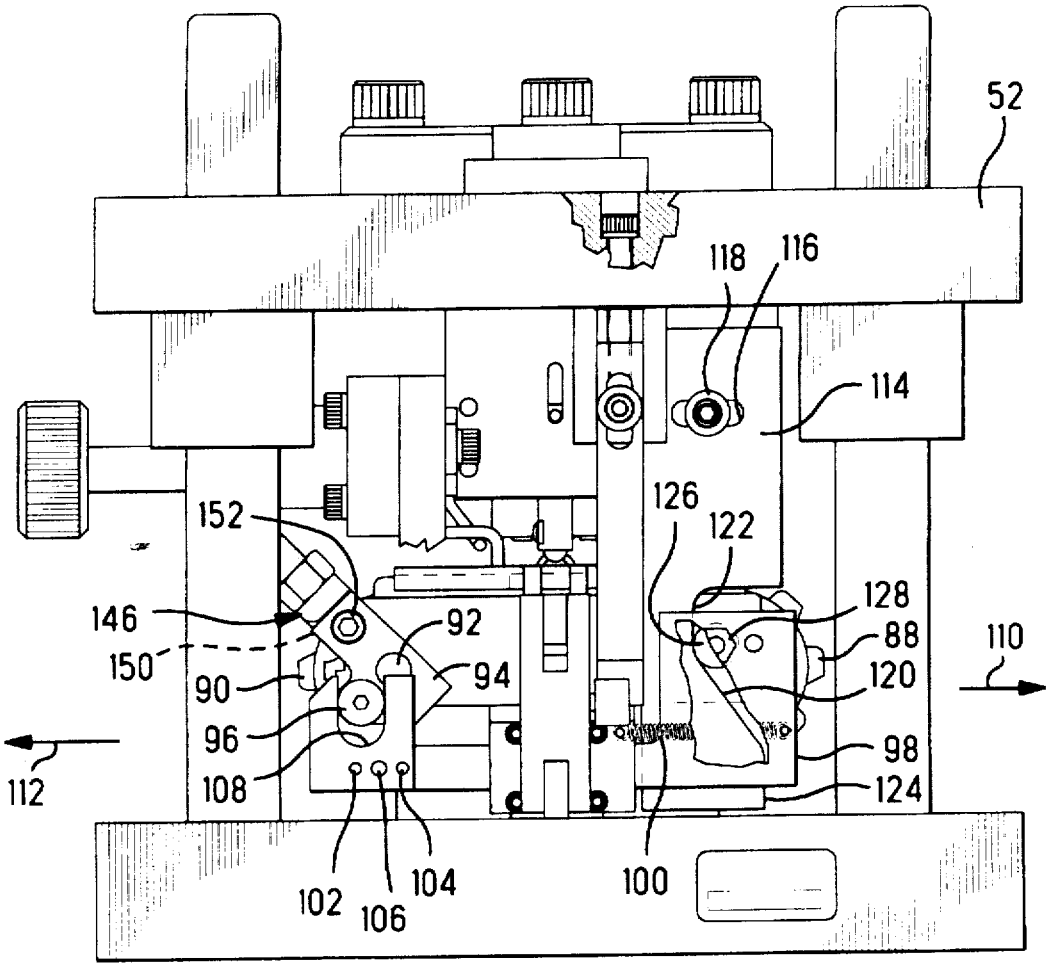
FIG. 6 is a back view of the machine shown in FIG. 4.
Figure 7:
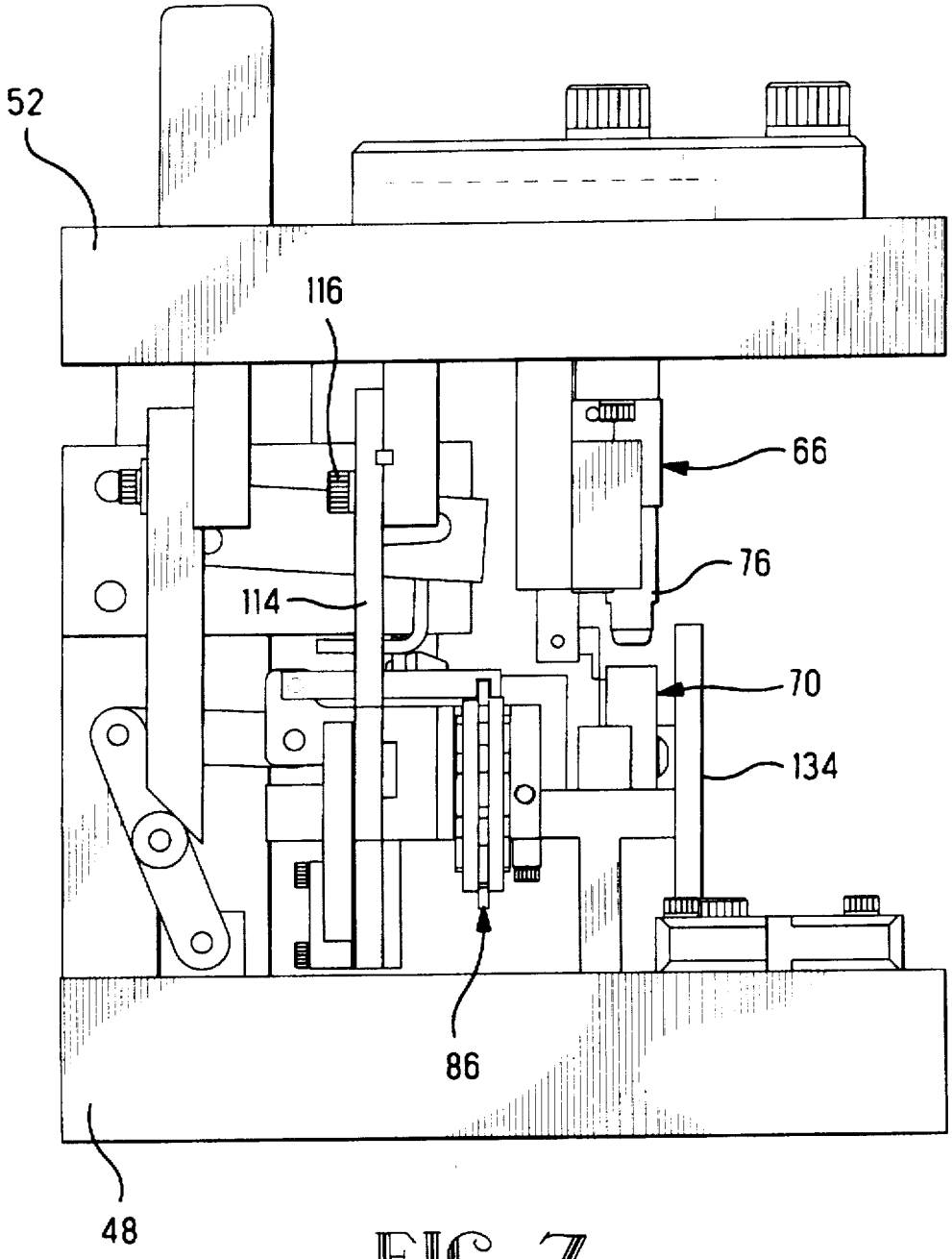
FIG. 7 is a left side view of the machine shown in FIG. 4.

A terminal strip feed mechanism 86, shown in FIGS. 4 and 6, includes a pair of feed wheels 88 and 90 that are journaled for rotation in the frame 62, the wheel 90 being coupled to a shaft 92, as best seen in FIG. 6, by means of a one way clutch, not shown. An actuating plate 94 is attached to the end of the shaft 92 and includes a follower 96 that is arranged off-center to the shaft 92. An L-shaped slide plate 98 is coupled to the frame 62 and arranged to freely slide left and right, as viewed in FIG. 6, but is biased toward the left by a spring 100 having one end attached to the frame and the other end attached to the slide plate. The left most end of the slide plate has a yoke 102 attached thereto by means of a pair of pins 104 and a screw 106 that is threaded into a hole in the slide plate. The yoke 102 includes an upwardly facing open slot 108 that is sized to closely receive the follower 96. As the slide plate 98 moves toward the right, as indicated by the arrow 110 in FIG. 6, the actuating plate 94 pivots counterclockwise, rotating the shaft 92 and the feed wheel 90 through the one way clutch. When the slide plate 98 moves toward the left, as indicated by the arrow 112 in FIG. 6, the actuating plate 94 pivots clockwise, rotating the shaft 92 clockwise as well but, due to the action of the one way clutch, the feed wheel 90 remains stationary.

The upper tooling unit 66 has a cam bar 114 attached thereto that is adjustable side to side by means of an elongated hole 116 formed in the cam bar and a screw 118 that extends therethrough and into a threaded hole in the upper tooling unit. The cam bar 114 includes an angled cam surface 120, an upper dwell surface 122, and a lower dwell surface 124. A follower roller 126 is journaled for rotation on a stud 128 that is attached to the slide plate 98 so that the follower roller is in following engagement with the cam surfaces 120 and 122, as shown in FIG. 6. Note that with the press ram 44 and upper plate 52 in their intermediate position, as shown in FIGS. 4 and 6, the follower roller 126 is positioned near the intersection of the two cam surfaces 120 and 122.

Figure 5:
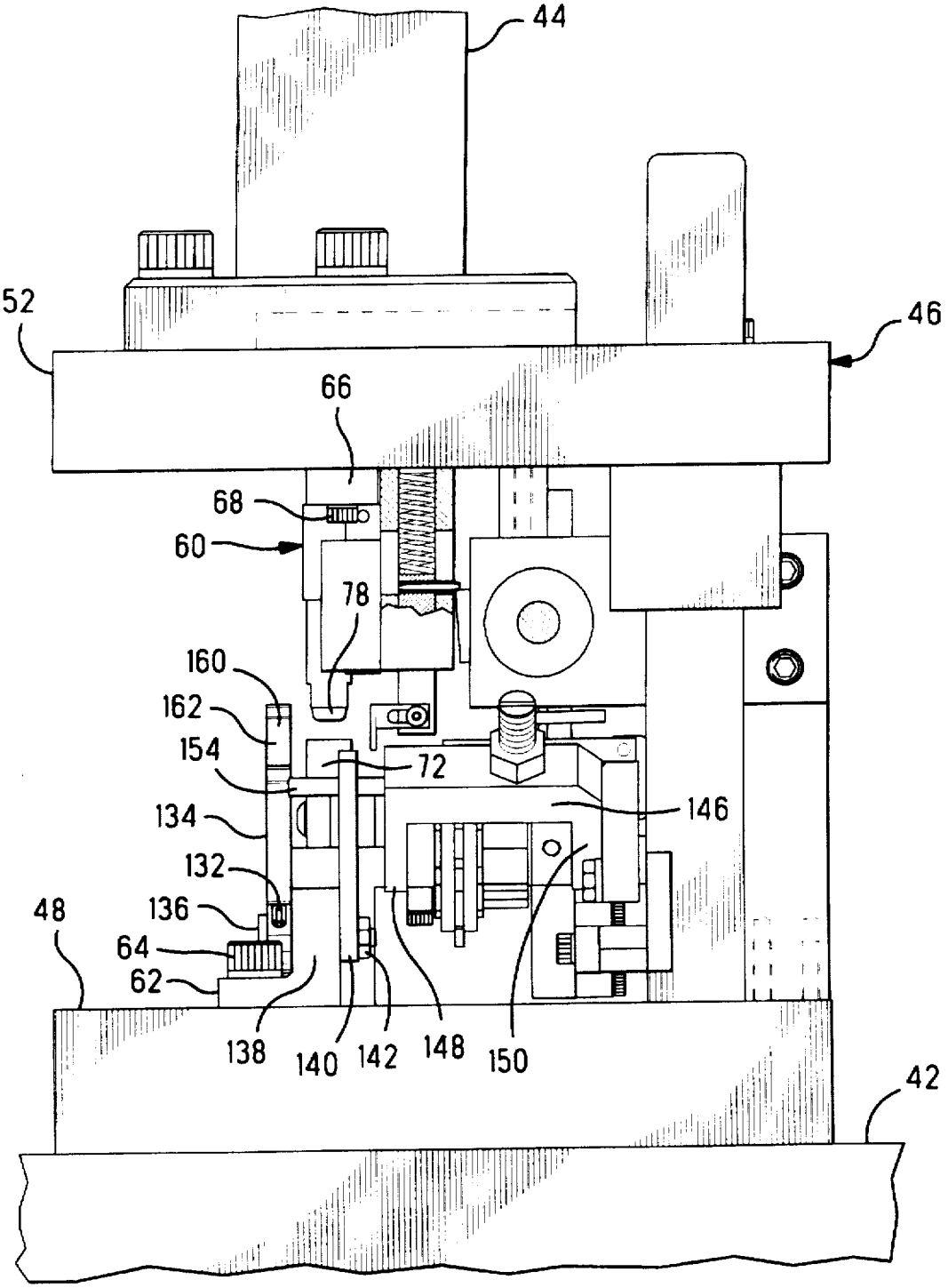
FIG. 5 is a right side view of the machine shown in FIG. 4.

A crimped wire assembly lift member 134 is pivotally attached to the frame 62 by means of a shoulder screw 136 that extends through slip fit holes in the lift member and a portion 138 of the frame. The lift member is pinned to the shoulder screw by means of a roll pin 132, as shown in FIG. 4. The threaded end of the shoulder screw extends through a clearance hole in an actuating lever 140 and a nut 142 is threaded onto the end to secure the actuating lever tightly to the shoulder screw, as shown in FIGS. 4 and 5, so that the assembly is free to pivot within the hole in the portion 138 of the frame. The actuating lever 140 includes an elongated hole 144 that is arranged along the longitudinal axis of the lever. A U-shaped drive yoke 146 has front and back legs 148 and 150, respectively, that straddle the feed wheel 90 and include slip fit holes through which the shaft 92 extends so that the drive yoke is free to pivot about the shaft. The back leg 150 is secured to the actuating plate 94 by means of a screw 152 that is threaded into a hole in the back leg so that, as the slide plate 98 is moved back and forth in the directions of the arrows 110 and 112, the drive yoke undergoes pivotal movement along with the actuating plate. As best seen in FIGS. 4 and 5, a drive pin 154 extends from and is carried by the U-shaped yoke 146, extending through the elongated hole 144 in the actuating lever 140 Therefore, as the slide plate 98 is made to move toward the right in the direction of the arrow 110, as viewed in FIG. 6, the drive yoke 146 is pivoted clockwise, as viewed in FIG. 4, causing the drive lever 140 and lift member 134 to pivot clockwise.

Figure 8:
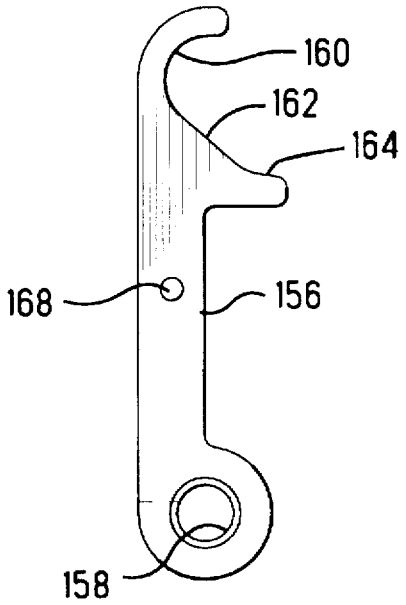
FIGS. 8 and 9 are front and side views of the lifting member shown in FIG. 4.
Figure 9:
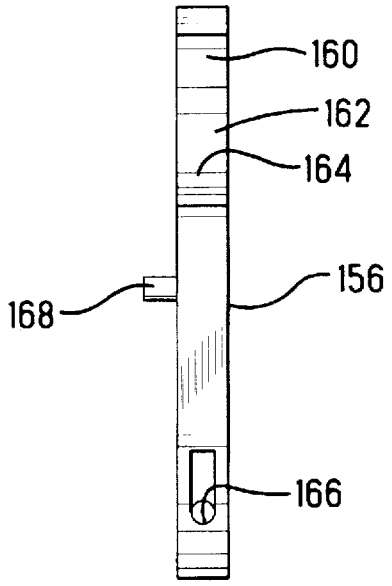

The lift member 134, as best seen in FIGS. 8 and 9, has an elongated body 156 having a slip fit hole 158 through one end thereof for receiving the shoulder screw 136. A hole 166 is formed through this end, intersecting the hole 158, for receiving the roll pin 132. The other end of the elongated body 156 includes a radiused surface 160 that smoothly blends in with a substantially flat angled camming surface 162 that has a flared portion 164. The surfaces 160, 162, and 164 are contiguous to form a single smooth surface A pin 168 extends from the side of the body 156, as shown in FIGS. 8 and 9, and serves as an attachment point for one end of a spring 170 having its other end secured to the frame 62 so that it urges the lift member 134, shoulder screw 136, and drive lever 140 assembly to pivot counterclockwise to their starting position shown in FIG. 4. An eccentric stop 178 is coupled to the frame 62 to serve to limit the counterclockwise movement of the lift member and to precisely align the flared portion 164 with respect to the nest 74 when in the intermediate position shown in FIG. 4

Figure 10:
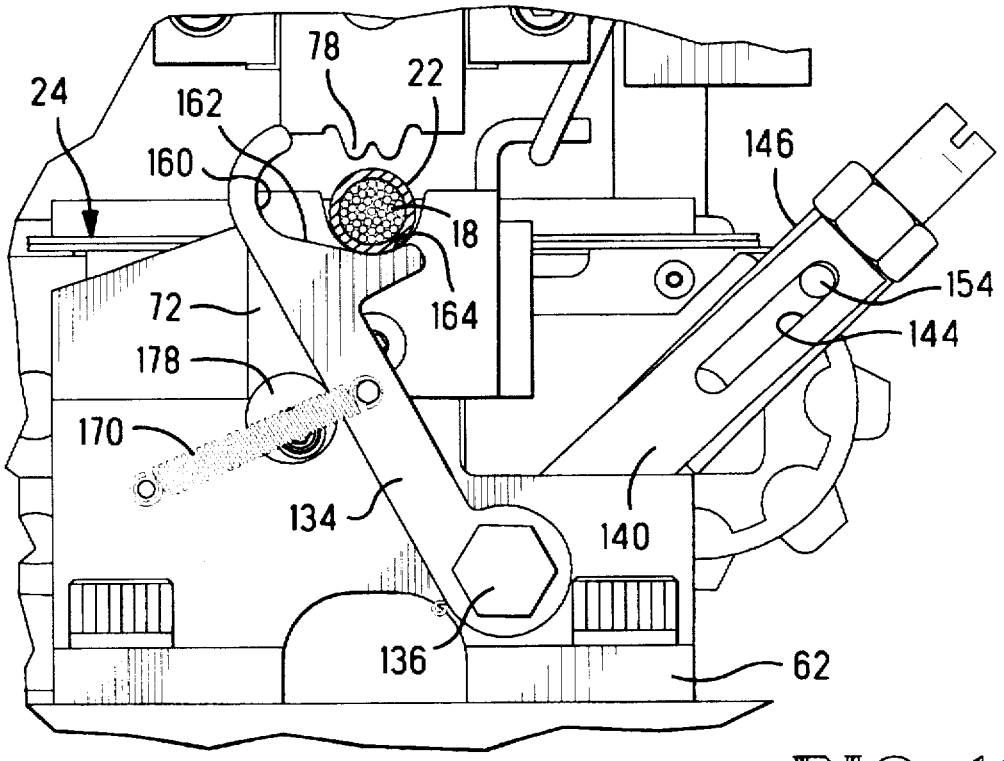
FIGS. 10 through 14 are front views of a portion of FIG. 4 showing the lifting member and crimping tooling in various operating positions.
Figure 11:
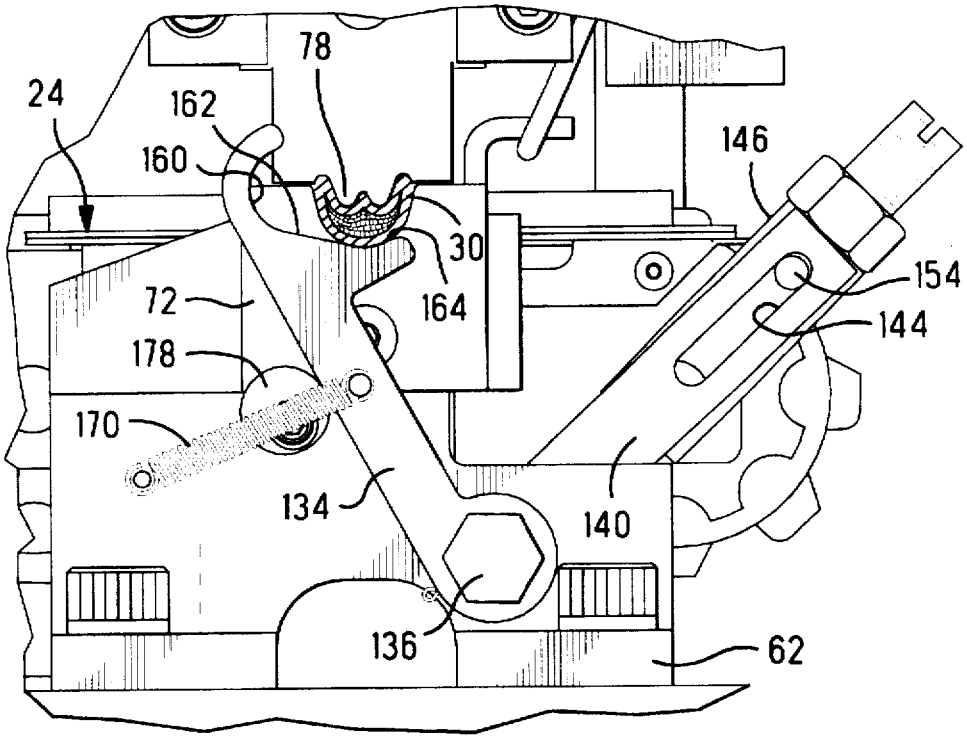
Figure 12:
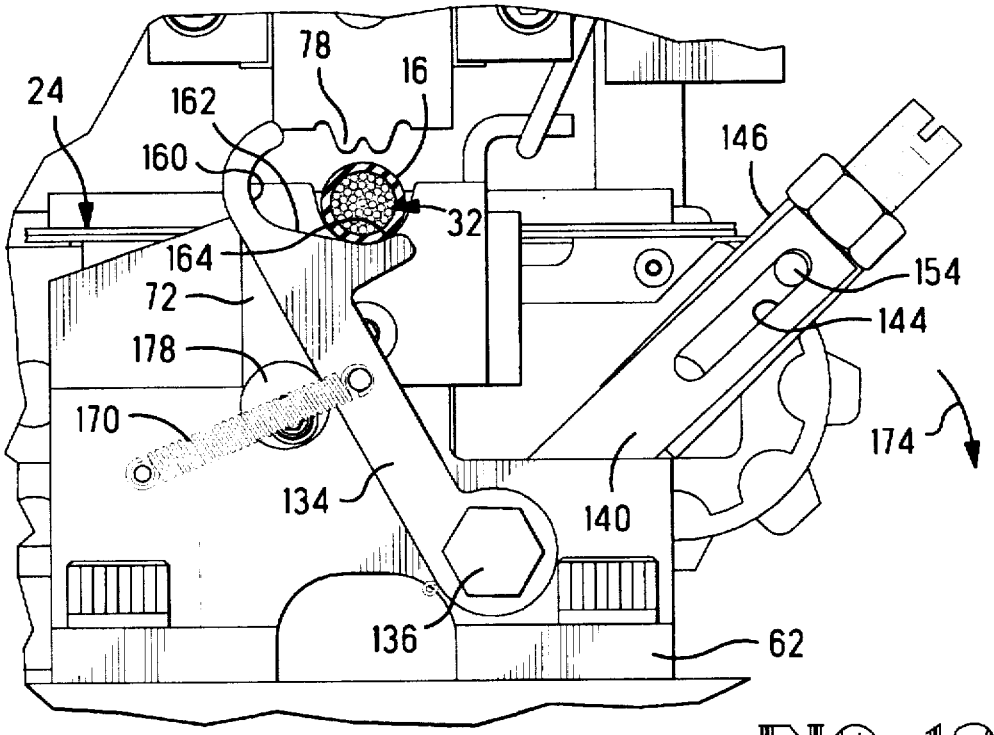
Figure 13:
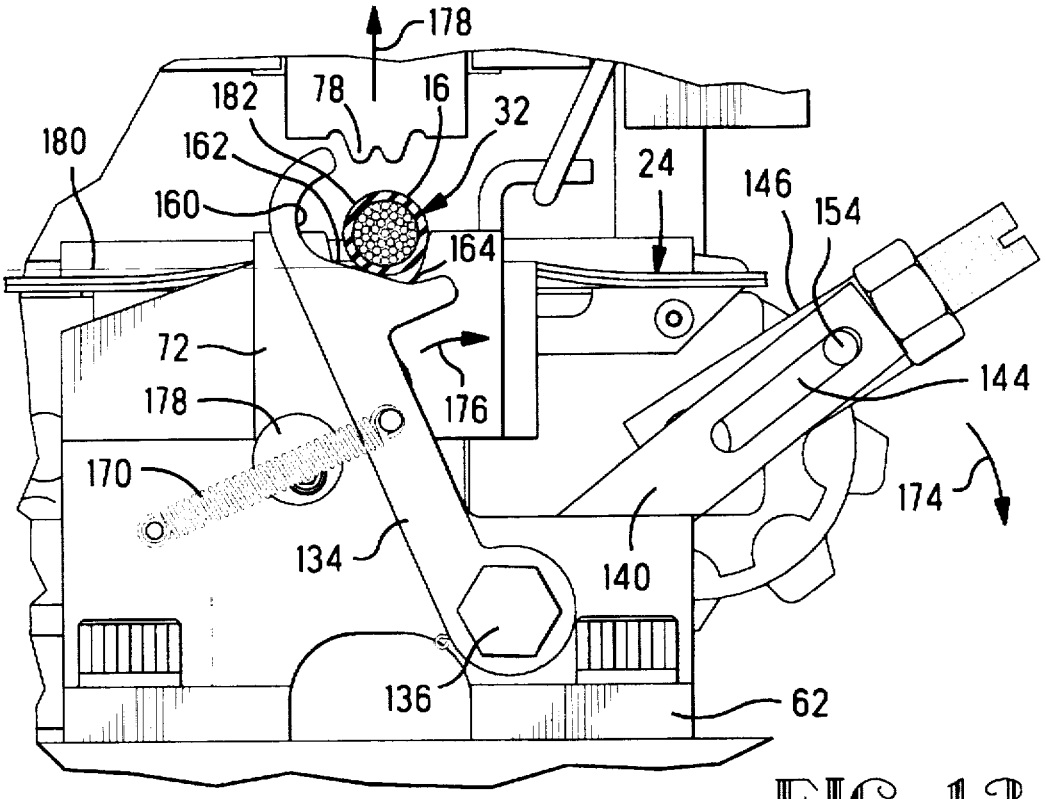
Figure 14:
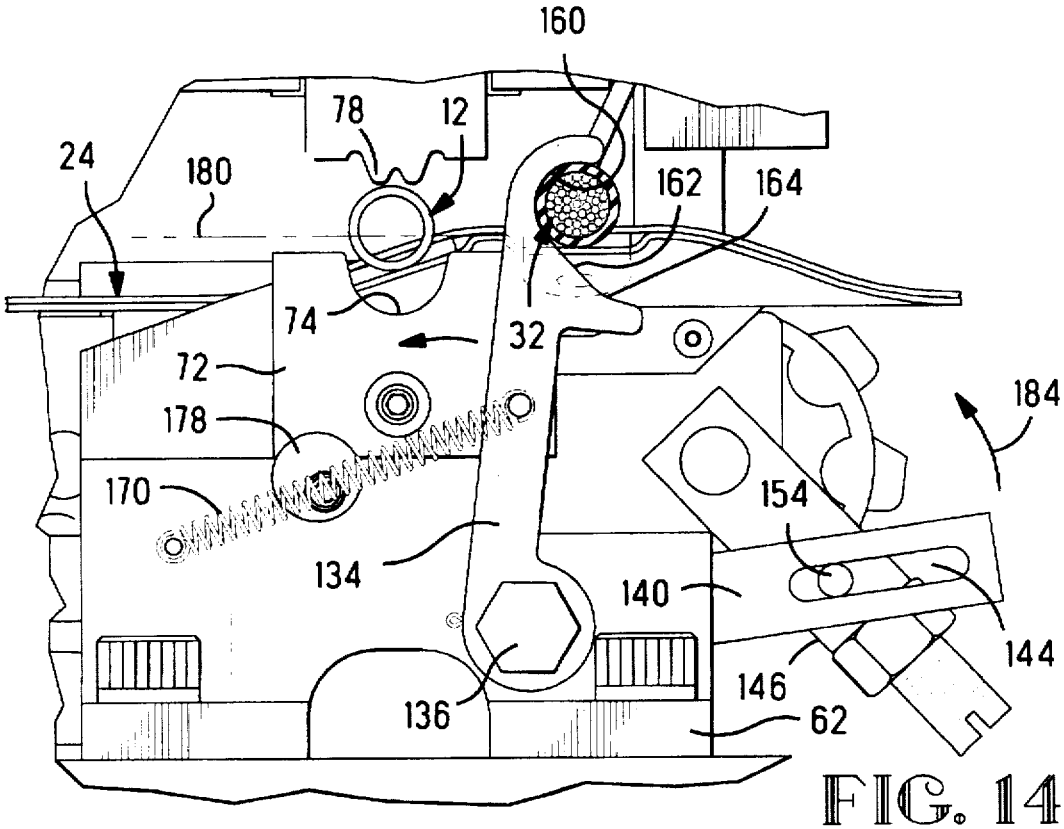

The operation of the machine 40 will now be described with reference to FIGS. 4, 6, and 10 through 14. To begin, it will be assumed that a strip 24 of terminals is properly positioned in the machine 40, a terminal 12 has been advanced into position in the nest 74 of the anvil 72, and the end 18 of a wire 10 inserted into the barrel 22, as shown in FIG. 10 where the wire end and barrel are shown in cross section. The upper plate 52 is in its intermediate position, shown in FIG. 4, with the die form 78 in engagement with the top surface of the barrel 22 under the urging of the spring 80. The press is actuated by the operator in the usual manner so that the press ram 44 moves the upper plate 52 downwardly from the intermediate position until the die form 78 crimps the barrel 22 and wire end 18 into a formed crimp 30, as shown in FIG. 11 where the crimp 30 is shown in cross section. As this occurs, the cam bar 114, shown in FIG. 6, also moves downwardly with the upper plate 52 so that the follower 126 rides along the upper dwell surface 122. The press ram 44 then reverses direction, raising the upper plate 52. As the upper plate 52 reaches its intermediate position, shown in FIGS. 4 and 12, the die form 78 has retreated from the crimp 30 and the cam bar 114 has moved upwardly so that the follower 126 is about to engage the angled cam surface 120, as shown in FIG. 6. Note that the lift member 134 is against the stop 178 and the outer surface of jacket 16 of the wire assembly 32, adjacent the crimped barrel 22, is resting on the flared portion 164 of the lift member, as shown in FIG. 12. As the press ram 44 and upper plate 52 continue to move upwardly, as viewed in FIG. 6, the angled surface 120 of the cam bar 114 moves upwardly as well causing the follower 126 to track along the angled surface so that the slide plate 98 is made to slide toward the right, as viewed in FIG. 6. As described above, this causes the shaft 92 and U-shaped drive yoke 146 to pivot clockwise, as viewed in FIG. 4, which, by means of the pin 154 riding in the elongated hole 144, causes the drive lever 140 to also pivot clockwise as indicated by the arrow 174 in FIGS. 12 and 13. As the drive lever 140 pivots clockwise, so does the shoulder screw 136 and attached lift member 134, as indicated by the arrow 176 in FIG. 13. As this occurs the angled camming surface 162 smoothly engages the outer jacket 16 of the crimped wire assembly 32, lifting it vertically upwardly, in the direction of the arrow 178, so that the crimped barrel 22 is cammed out of the nest 74, as shown in FIG. 13. Importantly, the angled camming surface 162 is angled with respect to the position of the shoulder screw 136 and the horizontal feed path 180 of the strip 24 of terminals so that the crimped barrel is cammed completely out of the nest 74 in the first ten to fifteen degrees of pivotal movement of the lift member 134. This assures that the feeding of the carrier strip is not hindered and that the crimped wire assembly is immediately removed from the area of the nest to make way for the next terminal to be fed into place. As the lift member 134 continues to pivot clockwise, the radiused abutting surface 160 extends around an upper portion 182 of the periphery of the jacket of the wire, as shown in FIG. 13, to limit vertical movement of the crimped wire assembly in the direction of the arrow 178. The abutting surface 160 then immediately engages the outer jacket 16 and moves the crimped wire assembly 32 laterally downstream toward the right to the position shown in FIG. 14. Concurrently with this movement the feed mechanism 86 has moved the strip 24 to the right so that the next terminal 12 is in vertical alignment with the nest 74. At this point the operator pulls the crimped wire assembly 32 axially away from the machine 40, the terminal portion 20 breaking the bond between the plastic strip 26 and the carrier strip 24 near the edges of the pocket 28, thus allowing the assembly to be removed. Concurrently, the press ram 44 reverses direction and moves the upper plate 52 downwardly to its intermediate position, shown in FIGS. 4 and 12, and stops. As the upper plate 52 moves downwardly the follower 126 tracks back on the angled cam surface 120 causing the yoke 146 and drive pin 154 to pivot the drive lever 140 counterclockwise in the direction of the arrow 184, as shown in FIG. 14, until the lift member 134 is in its position shown in FIG. 10. Again, in this position the die form 78 is urged against the top surface of the barrel 22 of the terminal by the spring 80, thereby holding it in the nest 74. The operator again inserts a wire end 18 into the barrel 22 and the process repeated any desired number of times.

An important advantage of the present invention is that the lifting member is a single rigid structure and is, therefore, inexpensive to manufacture. Additionally, by the pivotal motion of the lifting member about a single pivot axis, the crimped wire assembly can be first moved upwardly and out of the deep forming cavity of the anvil, then moved laterally in the direction of feed without the need for a complex mechanism capable of moving the assembly in two different directions. Further, the lift member of the present invention is capable of quickly removing the crimped barrel from the relatively deep formed crimping nest without interfering with normal feed operations of the carrier strip.

What is claimed is:

1. In an apparatus for crimping a terminal onto a wire thereby forming a crimped wire assembly wherein said apparatus includes a first tooling unit and a second tooling unit movable toward and matable with said first tooling unit in a work station for effecting said crimping, and a terminal feed unit for feeding a strip of terminals from an upstream side of said work station along a feed path through said work station toward a downstream side thereof, a lifting device for separating said crimped wire assembly from said first tooling unit comprising:

an arm pivotally attached to said first tooling unit and having a first end arranged so that when said arm is pivoted in a first direction said first end moves from a first position adjacent said work station to a second position on said downstream side of said work station, said first end having a camming surface arranged to engage said crimped wire assembly, said camming surface including a substantially flat angled surface and an abutting surface, wherein during said pivoting of said arm in said first direction, said substantially flat angled surface cams said crimped wire assembly out of said first tooling in a direction substantially perpendicular to said feed path, and then said abutting surface moves said wire assembly along said feed path in a direction toward said downstream side of said work station.

2. The apparatus according to claim 1 wherein said abutting surface extends around a portion of the periphery of said crimped wire assembly to limit movement of said crimped wire assembly in said direction substantially perpendicular to said feed path.

3. The apparatus according to claim 2 wherein said abutting surface is arcuate and contiguous to said angled surface.

4. The apparatus according to claim 1 wherein said pivoting of said arm in said first direction is effected upon movement of said second tooling unit in a direction away from said first tooling unit.

5. The apparatus according to claim 4 wherein said first tooling unit includes a cam bar attached thereto that drives a first follower for effecting said pivoting of said arm in said first direction.

6. The apparatus according to claim 5 wherein said first tooling unit includes a frame and said arm is attached to a shaft that extends through a hole in said frame and arranged to pivot therein on a first pivot axis, a yoke arranged to pivot on a second pivot axis displace from said first pivot axis, a first coupling drivingly interconnecting said first follower to said yoke, and a second coupling drivingly interconnecting said yoke and said arm for effecting said pivoting of said arm in said first direction.

7. The apparatus according to claim 6 wherein said second coupling comprises a drive lever attached to said arm by means of a common shaft, said drive lever having an elongated hole therein and said yoke including a drive pin extending therefrom and into said elongated hole, arranged so that when said yoke is pivoted about said second pivot axis said drive pin causes said drive lever to pivot about said first pivot axis.

8. In an apparatus for crimping a terminal onto a wire thereby forming a crimped wire assembly, including a first tooling unit and a second tooling unit movable toward and matable with said first tooling unit for effecting said crimping, and a terminal feed unit for feeding a strip of terminals along a feed path, a lifting device for separating said crimped wire assembly from said first tooling unit comprising an arm pivotally attached to said first tooling unit, said arm including a first end having a camming surface arranged to engage said crimped wire assembly, said camming surface including a substantially flat angled surface and an abutting surface, wherein during pivoting of said arm in a first direction, said substantially flat angled surface cams said crimped wire assembly out of said first tooling unit in a direction substantially perpendicular to said feed path, and then said abutting surface moves said wire assembly in a direction along said feed path.

9. The apparatus according to claim 8 wherein said abutting surface extends around a portion of the periphery of said crimped wire assembly to limit movement of said crimped wire assembly in said direction substantially perpendicular to said feed path.

10. The apparatus according to claim 9 wherein said abutting surface is arcuate and contiguous to said angled surface.

* * * * *